US011448996B2

(12) United States Patent
Yoshida et al.

(10) Patent No.: US 11,448,996 B2
(45) Date of Patent: Sep. 20, 2022

(54) IMAGING SYSTEM INCLUDING IMAGE CARRIER AND COATING ROLLER TO LUBRICATE IMAGE CARRIER

(71) Applicant: Hewlett-Packard Development Company, L.P., Spring, TX (US)

(72) Inventors: Yoichi Yoshida, Yokohama (JP); Koichiro Takashima, Yokohama (JP); Noriaki Kuroda, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/275,761

(22) PCT Filed: Apr. 17, 2019

(86) PCT No.: PCT/US2019/027874
§ 371 (c)(1),
(2) Date: Mar. 12, 2021

(87) PCT Pub. No.: WO2020/081117
PCT Pub. Date: Apr. 23, 2020

(65) Prior Publication Data

US 2022/0057742 A1 Feb. 24, 2022

(30) Foreign Application Priority Data

Oct. 19, 2018 (JP) ..... JP2018-197625

(51) Int. Cl.
*G03G 21/00* (2006.01)

(52) U.S. Cl.
CPC ..... *G03G 21/0094* (2013.01)

(58) Field of Classification Search
CPC ..... G03G 21/007
See application file for complete search history.

(56) References Cited

U.S. PATENT DOCUMENTS

| | | | | |
|---|---|---|---|---|
| 6,070,037 | A | 5/2000 | Sugihara et al. | |
| 7,826,786 | B2 * | 11/2010 | Suda | G03G 21/0011 399/346 |
| 9,098,020 | B2 | 8/2015 | Aiba | |
| 9,841,717 | B2 * | 12/2017 | Kikuchi | G03G 21/0011 |
| 2007/0183824 | A1 | 8/2007 | Suda et al. | |
| 2011/0164909 | A1 | 7/2011 | Nakane et al. | |
| 2011/0176845 | A1 | 7/2011 | Kanazawa et al. | |
| 2014/0037303 | A1 * | 2/2014 | Tomita | G03G 15/553 399/24 |
| 2015/0153704 | A1 | 6/2015 | Nishisaka | |
| 2016/0370747 | A1 | 12/2016 | Kawasaki et al. | |
| 2017/0336750 | A1 | 11/2017 | Haga | |
| 2019/0278213 | A1 * | 9/2019 | Kawakami | G03G 15/6567 |

FOREIGN PATENT DOCUMENTS

JP 2006-139111 A 6/2006

* cited by examiner

*Primary Examiner* — Leon W Rhodes, Jr.
(74) *Attorney, Agent, or Firm* — Jefferson IP Law, LLP

(57) ABSTRACT

An imaging system includes an image carrier to carry a toner image, a coating roller to transfer a lubricant from a lubricant source to a surface of the image carrier, the coating roller being disposed adjacent to the image carrier to receive a toner from the image carrier, and a toner adjustment element to adjust a toner amount of the coating roller in an axial direction of the coating roller.

15 Claims, 17 Drawing Sheets

IMAGING SYSTEM INCLUDING IMAGE CARRIER AND COATING ROLLER TO LUBRICATE IMAGE CARRIER

BACKGROUND

An imaging device may be used to apply a lubricant to a surface of an image carrier by a coating roller disposed adjacent to the image carrier in order to protect the surface of the image carrier.

DETAILED DESCRIPTION

In the following description, with reference to the drawings, the same reference numbers are assigned to the same components or to similar components having the same function, and overlapping description is omitted. An imaging system may be an imaging apparatus such as a printer or an image carrier polishing system mounted on the imaging apparatus.

Figure 1:
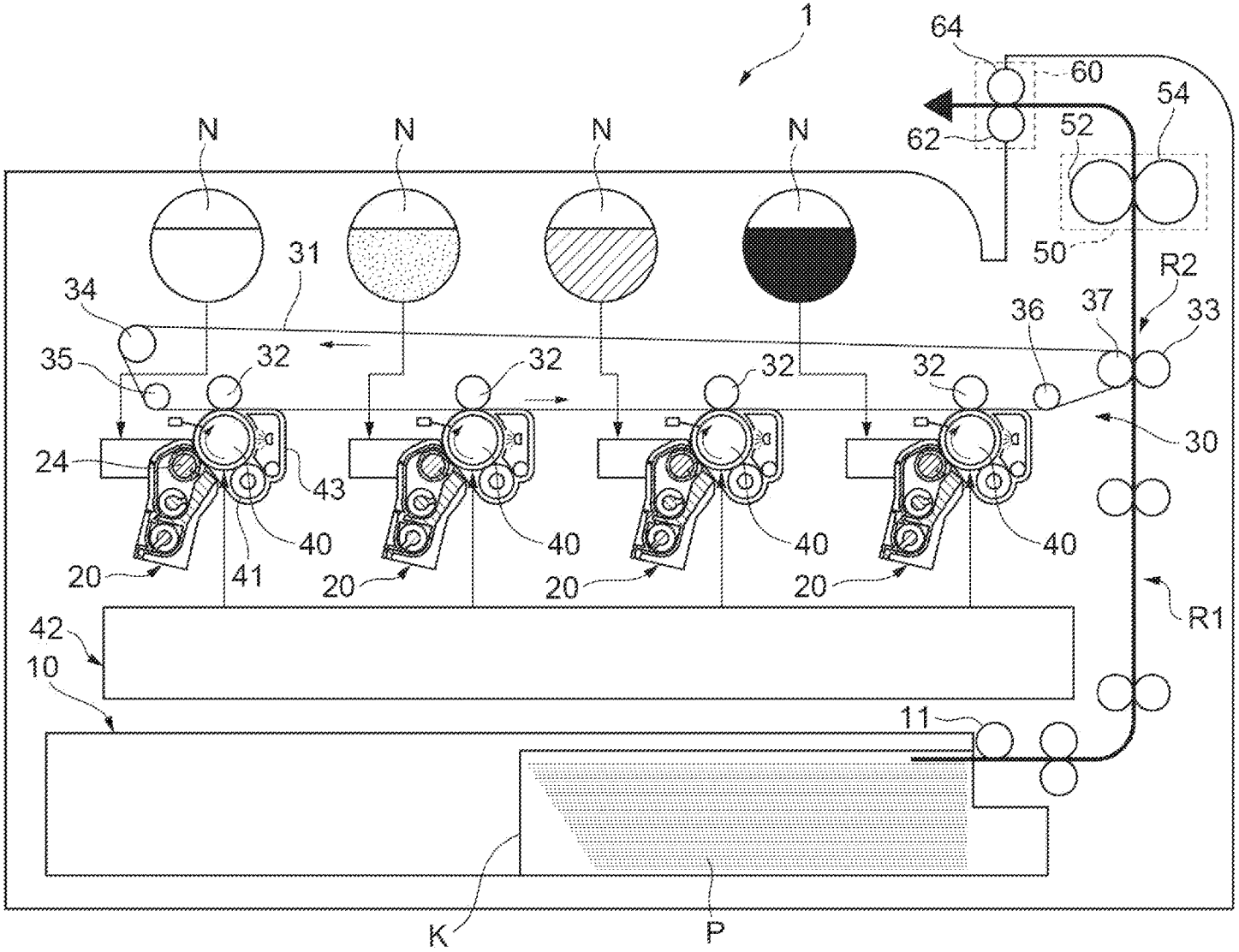
FIG. 1 is a schematic diagram illustrating an example imaging apparatus.

FIG. 1 is a diagram illustrating a schematic configuration of an example imaging apparatus 1. The imaging apparatus 1 may be configured to form a color image by using magenta, yellow, cyan, and black. The imaging apparatus 1 may include a conveying device 10 which conveys paper sheet P corresponding to a recording medium, a developing device 20 which develops an electrostatic latent image, a transfer device 30 which secondarily transfers a toner image to the paper sheet P, an image carrier 40 in which an electrostatic latent image is formed on a surface (a peripheral surface), a fixing device 50 which fixes a toner image to the paper sheet P, and a discharging device 60 which discharges the paper sheet P.

The conveying device 10 conveys, for example, the paper sheet P corresponding to a recording medium having an image formed thereon along a conveying route R1. The paper sheet P may be stacked and accommodated on a cassette K and is picked up and conveyed by a feeding roller 11. The conveying device 10 may be configured such that the paper sheet P reaches a transfer nip portion R2 through the conveying route R1, for example, at a timing in which the toner image transferred to the paper sheet P reaches the transfer nip portion R2.

A separate developing device 20 may be provided for each color, for example, each of four colors. Each developing device 20 may include a developing agent carrier 24 which carries toner on the image carrier 40. In the developing device 20, a two-component developing agent including toner and carrier may be used as a developing agent. In some examples, in the developing device 20, the toner and the carrier are adjusted to a predetermined mixing ratio and the toner and the carrier are mixed and stirred to uniformly disperse the toner. Accordingly, the developing agent is adjusted to have an optimal charge amount. The developing agent is carried by the developing agent carrier 24. The developing agent carrier 24 rotates to carry the developing agent to a region facing the image carrier 40. Then, the toner in the developing agent carried on the developing agent carrier 24 moves to the electrostatic latent image formed on the peripheral surface of the image carrier 40 so that the electrostatic latent image is developed.

The paper sheet P may be conveyed to the transfer nip portion R2 in which the transfer device 30 secondarily transfers the toner image formed by the developing device 20 to the paper sheet P. The transfer device 30 includes, for example, a transfer belt 31 to which the toner image is initially transferred from the image carrier 40, suspension rollers 34, 35, 36, and 37 on which the transfer belt 31 are suspended, a primary transfer roller 32 which sandwiches the transfer belt 31 along with the image carrier 40, and a secondary transfer roller 33 which sandwiches the transfer belt 31 along with the suspension roller 37.

The transfer belt 31 may include an endless belt which moves in a circulating manner by the suspension rollers 34, 35, 36, and 37. Each of the suspension rollers 34, 35, 36, and 37 may include a roller which is rotatable about each axis. The suspension roller 37 is, for example, a driving roller which rotates about the axis. Each of the suspension rollers 34, 35, and 36 may include a driven roller which is rotated by the rotation of the suspension roller 37. For example, the primary transfer roller 32 is provided to press the image carrier 40 from the inner peripheral side of the transfer belt 31. The secondary transfer roller 33 is disposed in parallel to the suspension roller 37 with, for example, the transfer belt 31 interposed therebetween and is provided to press the suspension roller 37 from the outer peripheral side of the transfer belt 31. Accordingly, the secondary transfer roller 33 forms the transfer nip portion R2 between the transfer belt 31 and the secondary transfer roller.

The image carrier 40 may include an electrostatic latent image carrier, a photosensitive drum, or the like. A separate image carrier 40 may be provided for each color, for example, each of four colors. Each image carrier 40 may be provided along the movement direction of the transfer belt 31. For example, the developing device 20, a charging roller 41, an exposure unit 42 (e.g., and exposure device), and a cleaning device 43 may be provided on the periphery of the image carrier 40.

The charging roller 41 may include a charging member that uniformly charges the surface of the image carrier 40 to a predetermined potential. In some examples, the charging roller 41 drives to follow the rotation of the image carrier 40, and the exposure unit 42 exposes the surface of the image carrier 40 charged by the charging roller 41 in response to an image formed on the paper sheet P. Accordingly, a potential of a portion exposed by the exposure unit 42 in the surface of the image carrier 40 changes so that the electrostatic latent image is formed. For example, four developing devices 20 form the toner images by developing the electrostatic latent image formed on the image carriers 40 using the toners supplied from toner tanks N respectively facing the developing devices 20. The toner tanks N are respectively filled with, for example, magenta, yellow, cyan, and black toners. The cleaning device 43 collects the toner remaining on the image carrier 40 after the toner image formed on the image carrier 40 is initially transferred to the transfer belt 31.

In some examples, the fixing device 50 may be configured such that the paper sheet P passes through a fixing nip portion R3 for heating and pressing the paper sheet so that the toner image secondarily transferred from the transfer belt 31 to the paper sheet P is adhered and fixed to the paper sheet P. The fixing device 50 may include a heating roller 52 which heats the paper sheet P and a pressing roller 54 which presses and rotates the heating roller 52. Each of the heating roller 52 and the pressing roller 54 may be formed in, for example, a cylindrical shape and the heating roller 52 includes a heat source such as a halogen lamp. The fixing nip portion R3 which is a contact region is provided between the heating roller 52 and the pressing roller 54 and the toner image is heated and fixed (e.g., fused) to the paper sheet P when the paper sheet P passes through the fixing nip portion R3.

The discharging device 60 includes, for example, discharging rollers 62 and 64 which discharge the paper sheet P having the toner image fixed thereto by the fixing device 50 to the outside of the apparatus.

An example printing process which may be performed using the imaging apparatus 1 is now described with reference to FIG. 1. When an image signal of a recording target image is input to the imaging apparatus 1, a control unit (e.g., a control device) of the imaging apparatus 1 rotates the feeding roller 11 so that the paper sheet P stacked in the cassette K is picked up and conveyed. Then, the surface of the image carrier 40 is uniformly charged to a predetermined potential by the charging roller 41 (a charging operation). Then, a laser beam is irradiated to the surface of the image carrier 40 by the exposure unit 42 on the basis of the received image signal to form an electrostatic latent image (an exposing operation).

In the developing device 20, the electrostatic latent image is developed and a toner image is formed (a developing operation). The toner image which is formed in this way is initially transferred from the image carrier 40 to the transfer belt 31 in a region in which the image carrier 40 and the transfer belt 31 face each other (a transferring operation). The toner images formed on four image carriers 40 are sequentially superimposed on the transfer belt 31 so that one composite toner image is formed. Then, the composite toner image is secondarily transferred to the paper sheet P conveyed from the conveying device 10 in the transfer nip portion R2 in which the suspension roller 37 and the secondary transfer roller 33 face each other.

The paper sheet P to which the composite toner image is secondarily transferred is conveyed to the fixing device 50. Then, the fixing device 50 fuses or otherwise fixes the composite toner image to the paper sheet P such as by heating and pressing the paper sheet P between the heating roller 52 and the pressing roller 54 when the paper sheet P passes through the fixing nip portion R3 (a fixing operation). Next, the paper sheet P is discharged to the outside of the imaging apparatus 1 by the discharging rollers 62 and 64.

Figure 2:
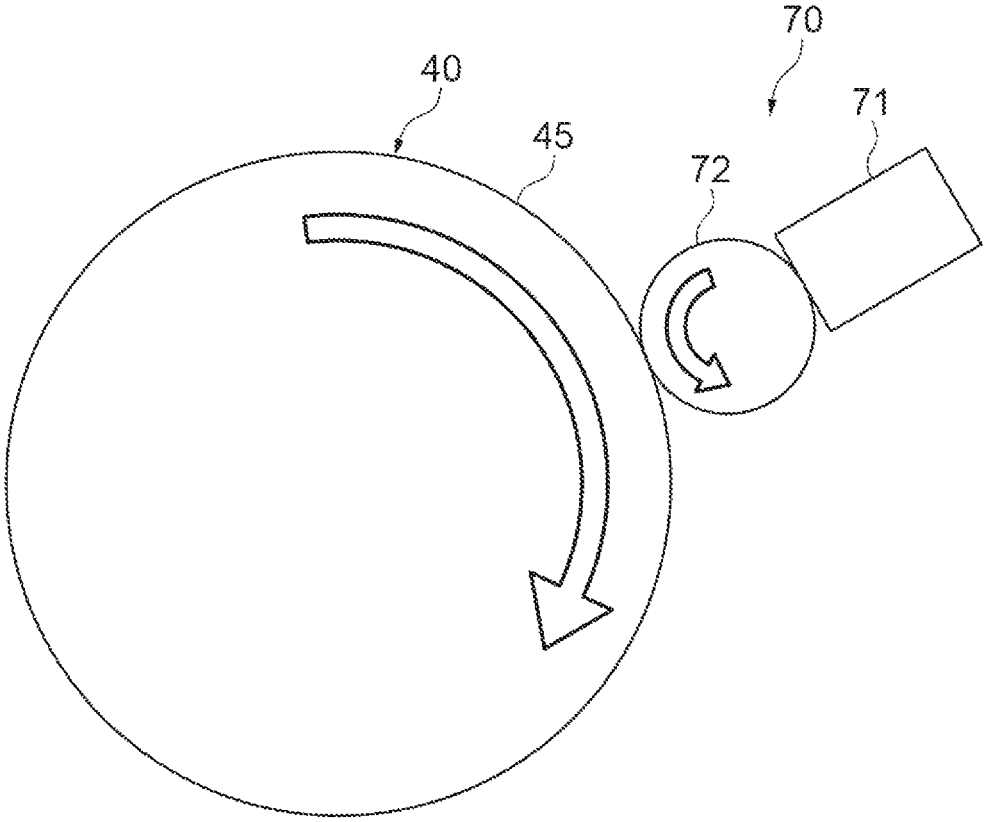
FIG. 2 is a schematic side view illustrating a basic configuration of an example lubricant application device.
Figure 3:
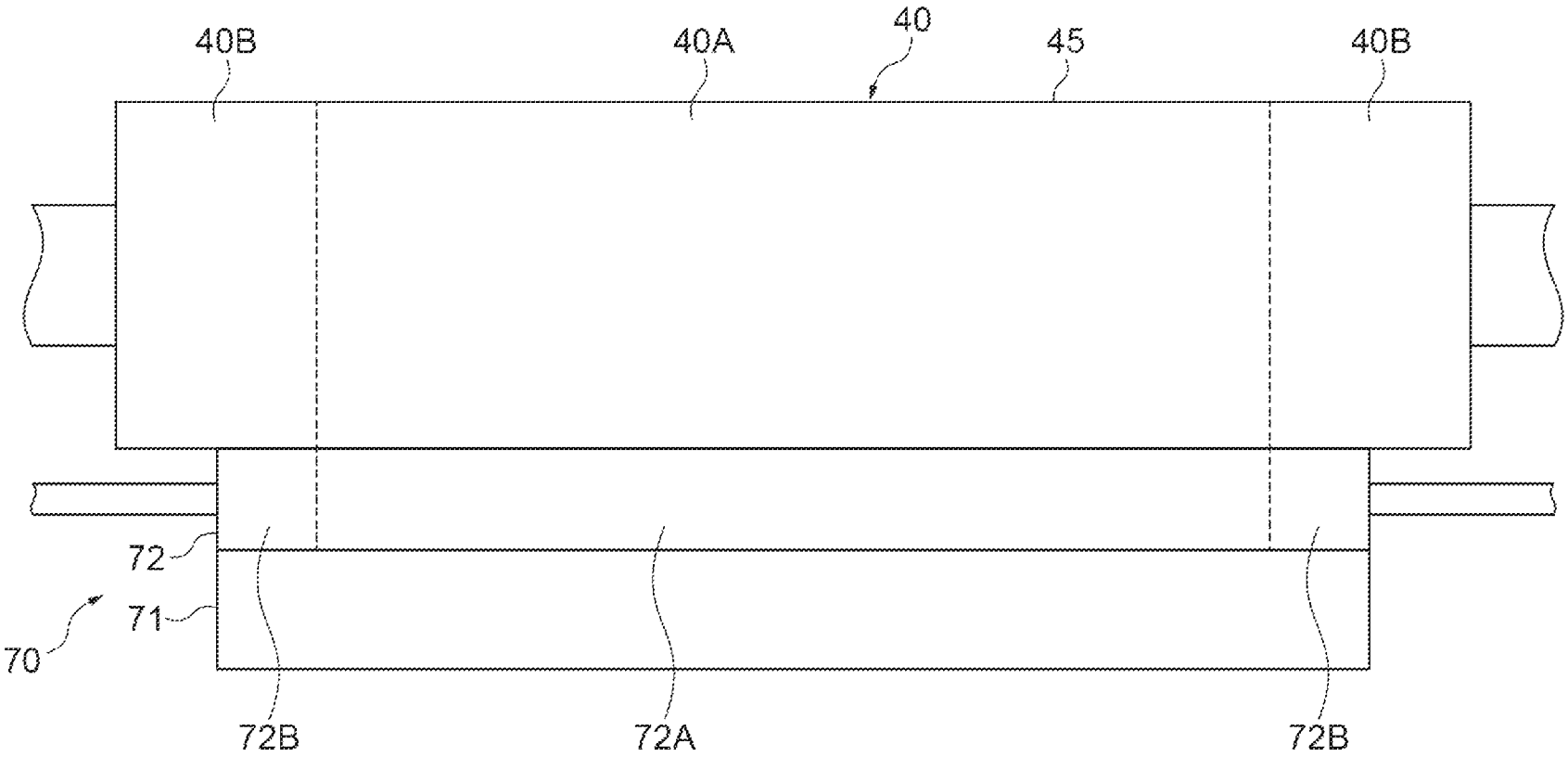
FIG. 3 is a front view of the lubricant application device illustrated in FIG. 2.

As illustrated in FIGS. 2 and 3, the imaging apparatus 1 includes an example lubricant application device 70. The lubricant application device 70 includes a lubricant source 71 and a coating roller 72. The lubricant application device 70 transfers the lubricant from the lubricant source 71 to a surface 45 of the image carrier 40 by the coating roller 72 to prevent, for example, the abrasion of the image carrier 40.

The lubricant source 71 may include, for example, a solid lubricant. The lubricant forming the lubricant source 71 may be formed of, for example, a material containing zinc stearate. The lubricant source 71 is urged to the coating roller 72 by an urging mechanism such as a coil spring.

The coating roller 72 transfers the lubricant from the lubricant source 71 to the image carrier 40. The coating roller 72 is disposed adjacent to the image carrier 40 at the downstream side of a region (a primary transfer region of the toner image) in which the image carrier 40 and the transfer belt 31 face each other in the rotational direction of the image carrier 40. The coating roller 72 is supported to be rotatable about the center axis of the coating roller 72 by, for example, a support body directly or indirectly attached to the casing of the imaging apparatus 1. The center axis (the rotational axis) of the coating roller 72 is parallel to the center axis (the rotational axis) of the image carrier 40. Then, the coating roller 72 rotates to scrape off the lubricant from the lubricant source 71 and the scraped lubricant is applied to the image carrier 40.

The coating roller 72 may include a drive roller or a driven roller. The coating roller 72 contacts the image carrier 40 to generate a friction resistance with respect to the image carrier 40. In some examples, when the coating roller 72 is the driven roller, the coating roller 72 rotates to follow the rotation of the image carrier 40.

Figure 4:
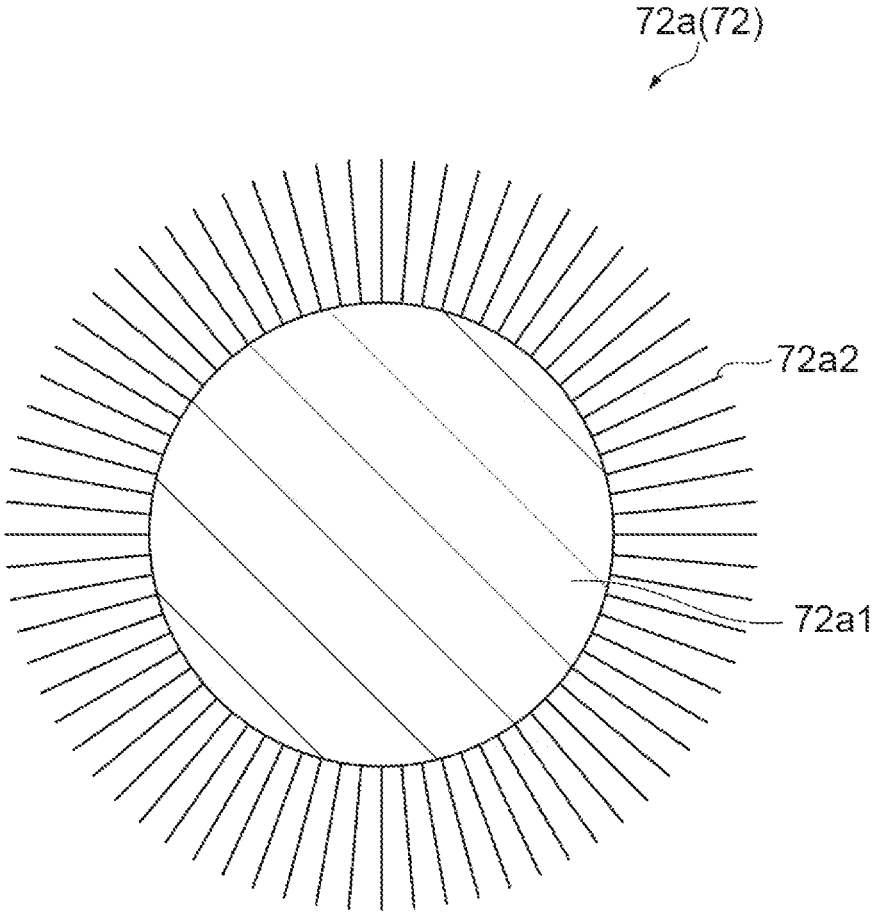
FIG. 4 is a schematic cross-sectional view illustrating an example brush roller.
Figure 5:
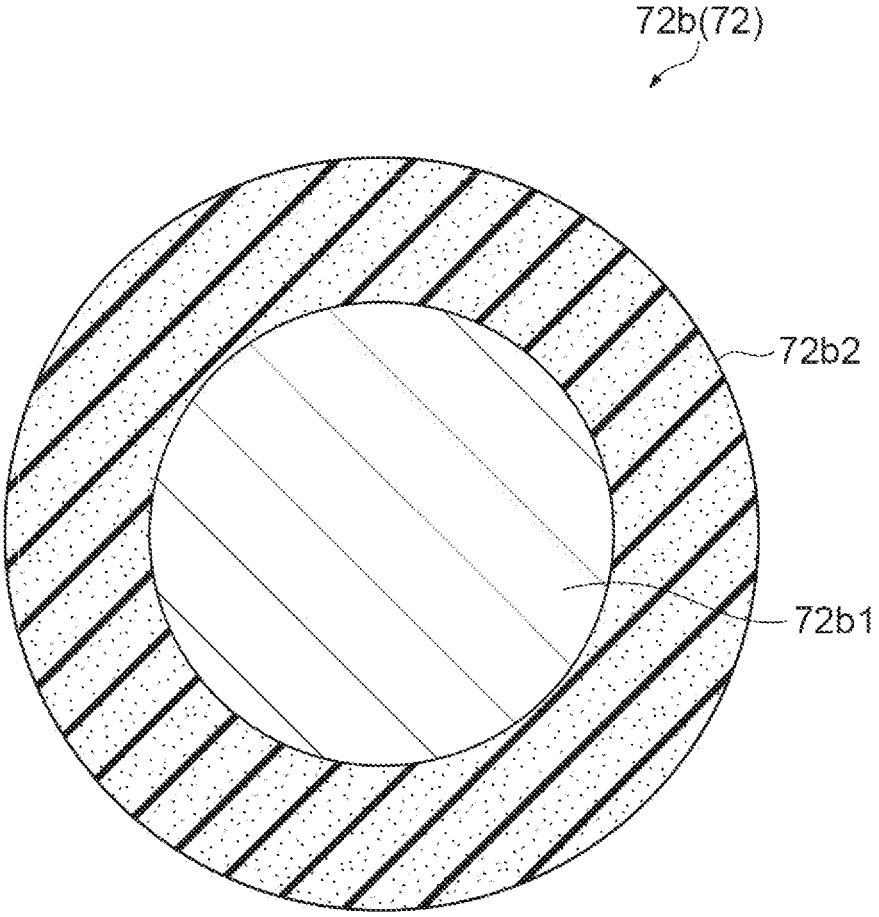
FIG. 5 is a schematic cross-sectional view illustrating an example elastic roller.

In some examples, a brush roller 72*a* illustrated in FIG. 4, an elastic roller 72*b* illustrated in FIG. 5, or the like can be used as the coating roller 72. The brush roller 72*a* has, for example, a configuration in which a plurality of bristles 72*a*2 are implanted (fixed) to a peripheral surface of a roller shaft 72*a*1. The material of the bristles 72*a*2 is may include an acrylic fiber, a nylon fiber, or a PET fiber. The elastic roller 72*b* may include a configuration in which a sponge-like elastic body 72*b*2 is attached to a peripheral surface of a roller shaft 72*b*1. Additionally, urethane, ethylene-propylene-diene rubber (EPDM), and the like can be used as the elastic body 72*b*2.

As illustrated in FIG. 3, the surface 45 of the image carrier 40 includes an image area 40A which carries the toner image and a non-image area 40B which is located at the outside of the image area 40A and does not carry the toner image. The image area 40A is located at the center portion of the image carrier 40 in the axial direction and the non-image area 40B is located at both end portions of the image carrier 40 in the axial direction. The image area 40A is a specific area which is set in the image carrier 40 and is a maximum area which carries the toner image in the axial direction of the image carrier 40.

The coating roller 72 includes a first portion 72A which contacts the image area 40A of the image carrier 40 and a second portion 72B which contacts the non-image area 40B of the image carrier 40. The first portion 72A is located at the center portion of the coating roller 72 in the axial direction and the second portion 72B is located at both end portions of the coating roller 72 in the axial direction.

In some examples, the toner image carried by the image carrier 40 is transferred to the transfer belt 31 (see FIG. 1), but a part of the toner of the toner image is not transferred to the transfer belt 31 and remains on the image area 40A of the image carrier 40. A part of the toner remaining on the image carrier 40 is transferred to the coating roller 72 in such a manner that the coating roller 72 contacts the image carrier 40. Accordingly, the coating roller 72 carries the toner by receiving the toner from the image carrier 40. The toner which is carried on the coating roller 72 has a function of scraping off the lubricant from the lubricant source 71. In some examples, as the amount of the toner carried on the coating roller 72 increases, the amount of the lubricant scraped off from the lubricant source 71 increases and the amount of the lubricant applied to the image carrier 40 increases.

In the surface 45 of the image carrier 40, the toner image may be selectively or exclusively carried on the image area 40A and the toner image is not carried on the non-image area 40B. In some examples, in the coating roller 72, the toner is readily transferred to the first portion 72A contacting the image area 40A and the toner is not readily transferred to the second portion 72B contacting the non-image area 40B. For example, the toner amount (the toner carriage amount) of the second portion 72B of the coating roller 72 becomes smaller than the toner amount of the first portion 72A of the coating roller 72. Then, the amount of the lubricant scraped off from the lubricant source 71 in the second portion 72B of the coating roller 72 becomes smaller than the amount of the lubricant scraped off from the lubricant source 71 in the first portion 72A of the coating roller 72. Accordingly, the lubricant application amount in the non-image area 40B of the image carrier 40 becomes smaller than the lubricant application amount in the image area 40A of the image carrier 40. If there is an insufficient amount of lubricant application amount in the non-image area 40B of the image carrier 40, a rate of abrasion may increase.

In some examples, the imaging apparatus 1 includes a toner adjustment element which adjusts the toner amount of the coating roller 72 in the axial direction of the coating roller 72 in order to reduce a variation in toner amount of the coating roller 72 in the axial direction of the coating roller 72. The toner adjustment element selectively changes the toner amount of at least one of the first portion 72A of the coating roller 72 and the second portion 72B of the coating roller 72 so that, for example, a difference between the toner amount of the second portion 72B of the coating roller 72 and the toner amount of the first portion 72A of the coating roller 72 decreases. Further, the toner adjustment element may selectively change the toner amount of at least one of the first portion 72A of the coating roller 72 and the second portion 72B of the coating roller 72 in order to apply a substantially uniform lubricant layer across, for example, the image area 40A and the non-image area 40B of the image carrier 40.

Figure 6:
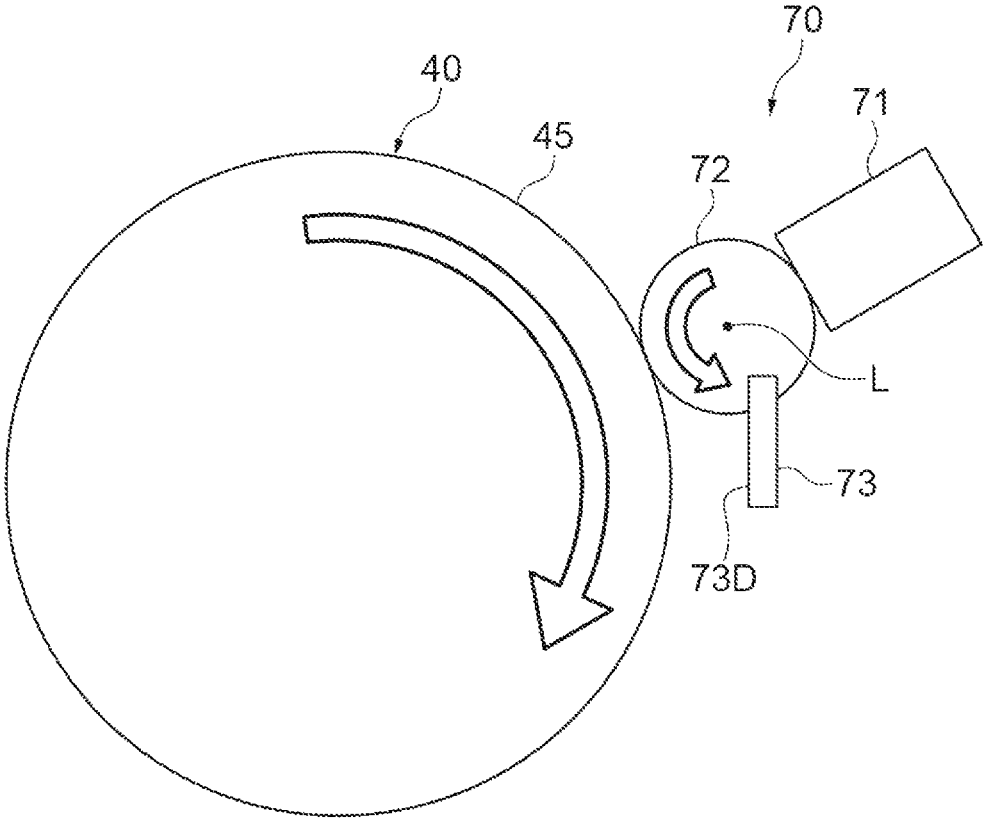
FIG. 6 is a schematic side view illustrating a lubricant application device including an example scraper.

As illustrated in FIG. 6, the lubricant application device 70 includes a scraper 73 which is the toner adjustment element. The scraper 73 is also called a scrapper, a scrapping member, or the like. The scraper 73 is disposed adjacent to the coating roller 72 in order to scrape off, for example, the toner from the coating roller 72.

Figure 7:
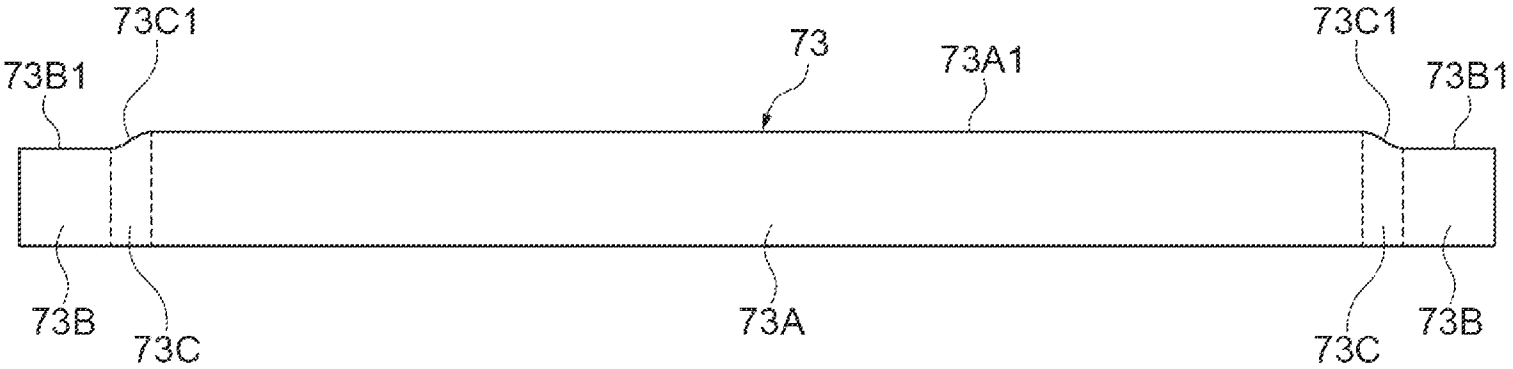
FIG. 7 is a schematic front view illustrating an example scraper.

As illustrated in FIG. 7, the scraper 73 may be formed in, for example, an elongated plate shape. The scraper 73 includes a first scraping portion 73A, a second scraping portion 73B, and an intermediate scraping portion 73C. The first scraping portion 73A engages with the first portion 72A of the coating roller 72 in the scraper 73. The first scraping portion 73A is located at the center portion in the extension direction of the scraper 73. The second scraping portion 73B engages with the second portion 72B of the coating roller 72 in the scraper 73. The second scraping portion 73B is located at both end portions of the scraper 73 in the extension direction. The intermediate scraping portion 73C extends between the first scraping portion 73A and the second scraping portion 73B in the scraper 73. The intermediate scraping portion 73C is located at both sides of the first scraping portion 73A in the extension direction of the scraper 73 and is adjacent to the first scraping portion 73A and the second scraping portion 73B. Furthermore, a boundary position between the image area 40A and the non-image area 40B of the image carrier 40 may correspond to a boundary position between the first scraping portion 73A and the intermediate scraping portion 73C. In some examples, the boundary position may correspond to any position of the intermediate scraping portion 73C, and in other examples, the boundary position may correspond to a boundary position between the intermediate scraping portion 73C and the second scraping portion 73B.

Figure 8:
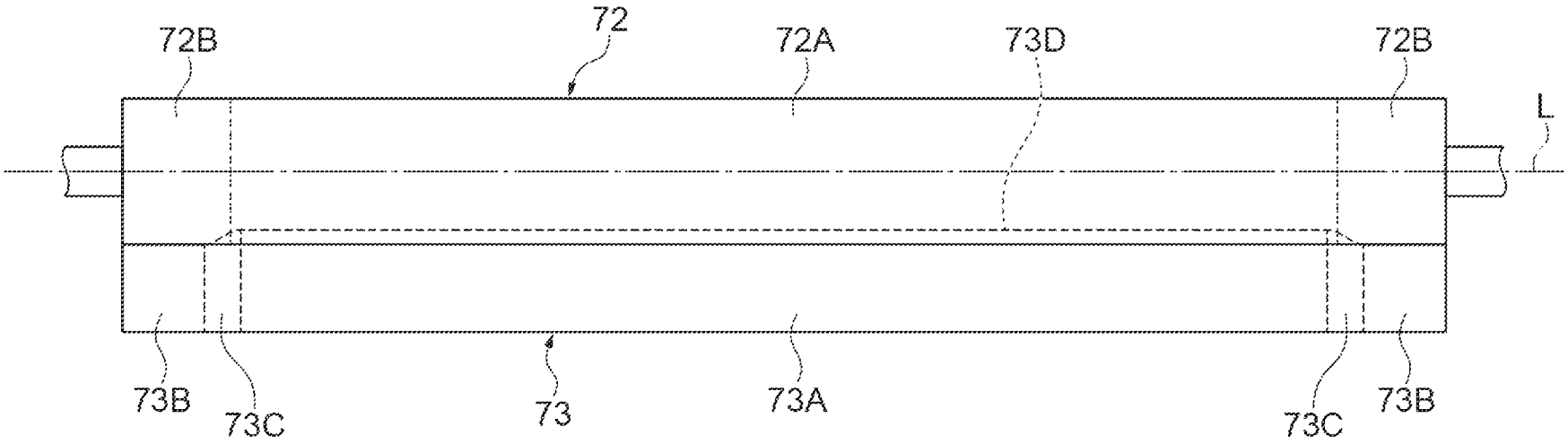
FIG. 8 is a schematic front view illustrating an example positional relationship between a coating roller and the scraper illustrated in FIG. 7.
Figure 9:
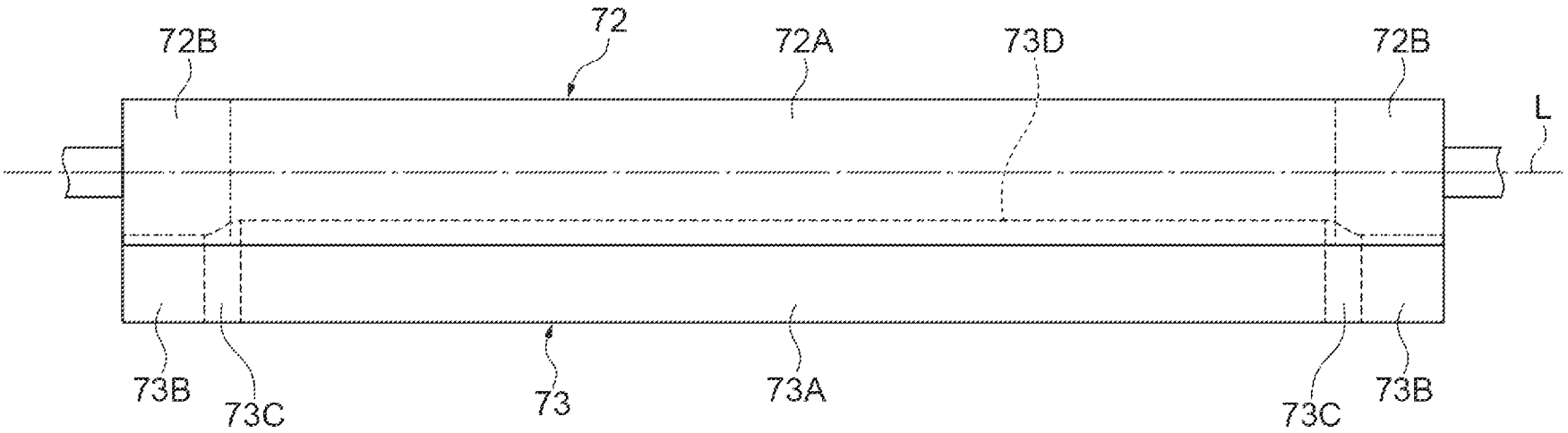
FIG. 9 is a schematic front view illustrating an example positional relationship between the coating roller and the scraper illustrated in FIG. 7.

As illustrated in FIGS. 7 to 9, an edge on the side of, or offset from, the center axis L of the coating roller 72 of the first scraping portion 73A is set as a first edge 73A1, an edge on the side of, or offset from the center axis L of the coating roller 72 of the second scraping portion 73B is set as a second edge 73B1, and an edge on the side of, or offset from, the center axis L of the coating roller 72 of the intermediate scraping portion 73C is set as an intermediate edge 73C1. The first edge 73A1 of the first scraping portion 73A protrudes toward the center axis L of the coating roller 72 in relation to the second edge 73B1 of the second scraping portion 73B. The width of the first scraping portion 73A may be greater than the width of the second scraping portion 73B in a direction orthogonal to the extension direction of the scraper 73 (the axial direction of the coating roller 72). The intermediate edge 73C1 of the intermediate scraping portion 73C is inclined with respect to the center axis L of the coating roller 72.

An end portion on the side of the intermediate scraping portion 73C of the first edge 73A1 of the first scraping portion 73A may be formed in a linear shape or may be formed in a curved shape toward the second edge 73B1 of the second scraping portion 73B. An end portion on the side of the intermediate scraping portion 73C of the second edge 73B1 of the second scraping portion 73B may be formed in a linear shape or may be formed in a curved shape toward the first edge 73A1 of the first scraping portion 73A.

The intermediate edge 73C1 of the intermediate scraping portion 73C may be formed in a curved shape or a linear shape. When the intermediate edge 73C1 of the intermediate scraping portion 73C is formed in a curved shape, the first edge 73A1 of the first scraping portion 73A and the intermediate edge 73C1 of the intermediate scraping portion 73C may be connected in a curved shape and the second edge 73B1 of the second scraping portion 73B and the intermediate edge 73C1 of the intermediate scraping portion 73C may be connected in a curved shape.

As illustrated in FIGS. 6, 8, and 9, the scraper 73 is disposed to penetrate into the coating roller 72. As illustrated in FIG. 8, the scraper 73 may be disposed so that the second scraping portion 73B and the intermediate scraping portion 73C do not penetrate into the coating roller 72. Further, as illustrated in FIG. 9, the scraper 73 may be disposed so that the first scraping portion 73A, the second scraping portion 73B, and the intermediate scraping portion 73C penetrate into the coating roller 72. Further, the scraper 73 may be disposed so that a part of the intermediate scraping portion 73C penetrates into the coating roller 72. Furthermore, the amount of the scraper 73 that penetrates into the coating roller 72 may be adjusted by providing a movement mechanism for moving the scraper 73.

Here, the ability of scraping off the toner from the coating roller 72 by the scraper 73 increases as the amount of the scraper 73 that penetrates into the coating roller 72 increases. For example, when the coating roller 72 is the brush roller 72*a* (see FIG. 4), the scraper 73 drops the toner from the coating roller 72 by rubbing the bristles 72*a*2. Since the bending amount of the bristles 72*a*2 by the scraper 73 increases as the amount of the scraper 73 that penetrates into the coating roller 72 increases, more toner is dropped from the coating roller 72. Further, for example, when the coating roller 72 is the elastic roller 72*b* (see FIG. 5), the scraper 73 drops the toner from the coating roller 72 by pressing the elastic body 72*b*2 to increase a contact friction with the elastic body 72*b*2. Since the amount of the elastic body 72*b*2 pressed by the scraper 73 increases as the amount of the scraper 73 that penetrates into the coating roller 72 increases, more toner is dropped from the coating roller 72.

In some examples, the first edge 73A1 of the first scraping portion 73A protrudes toward the center axis L of the coating roller 72 in relation to the second edge 73B1 of the second scraping portion 73B. Therefore, the toner is readily scraped off by the scraper 73 at the first portion 72A of the coating roller 72 in relation to the second portion 72B of the coating roller 72. Accordingly, the difference between the toner amount of the first portion 72A of the coating roller 72 and the toner amount of the second portion 72B of the coating roller 72 (a toner amount differential) decreases or is reduced.

In some examples, the intermediate edge 73C1 of the intermediate scraping portion 73C is inclined with respect to the center axis L of the coating roller 72. Therefore, a sudden change in toner amount may be prevented between a portion of the coating roller 72 that engages with the first scraping portion 73A and a portion of the coating roller 72 that engages with the second scraping portion 73B. Accordingly, a substantially uniform lubricant layer may be applied across, for example, the image area 40A and the non-image area 40B of the image carrier 40.

When the intermediate edge 73C1 of the intermediate scraping portion 73C is formed in a curved shape, a sudden change in toner amount may be prevented.

Further, when the first edge 73A1 of the first scraping portion 73A and the intermediate edge 73C1 of the intermediate scraping portion 73C are connected in a curved shape and/or when the second edge 73B1 of the second scraping portion 73B and the intermediate edge 73C1 of the intermediate scraping portion 73C are connected in a curved shape, a sudden change in toner amount may be prevented.

As illustrated in FIG. 6, the scraper 73 includes a scraping surface 73D. The scraping surface 73D is an upstream surface of the coating roller 72 in the rotational direction.

Figure 10:
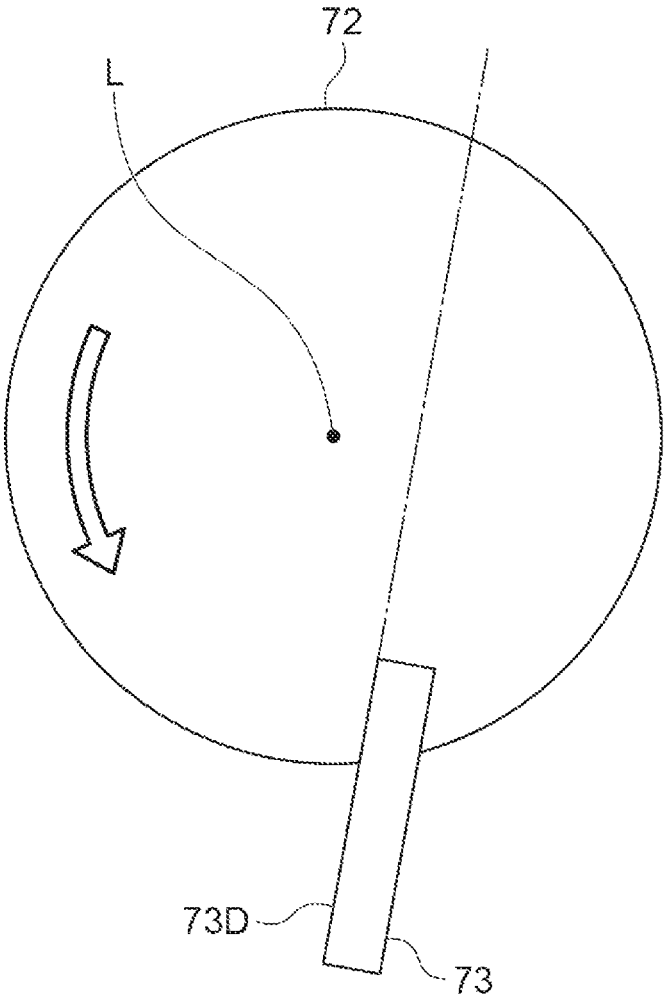
FIG. 10 is a schematic side view illustrating an example positional relationship between the coating roller and the scraper illustrated in FIG. 7.
Figure 11:
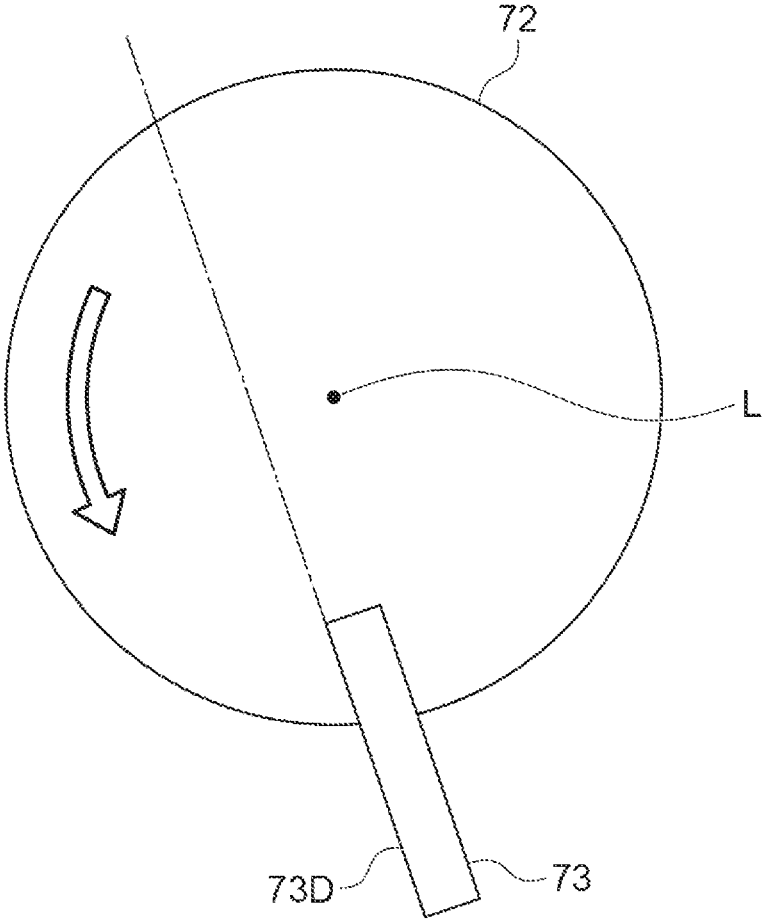
FIG. 11 is a schematic side view illustrating an example positional relationship between the coating roller and the scraper illustrated in FIG. 7.
Figure 12:
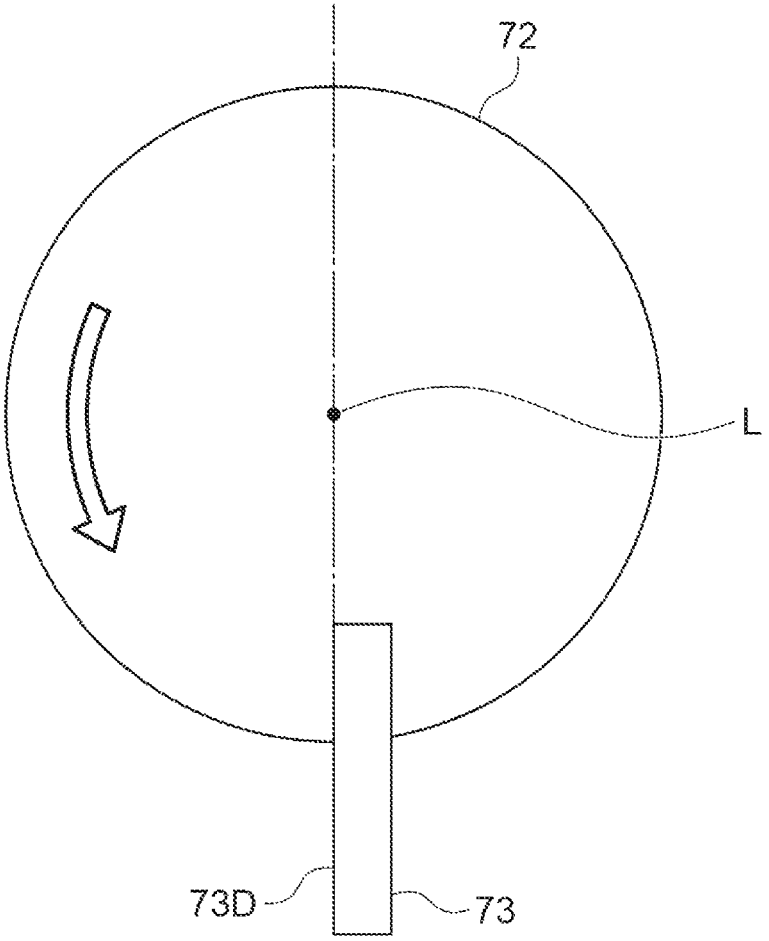
FIG. 12 is a schematic side view illustrating an example positional relationship between the coating roller and the scraper illustrated in FIG. 7.

The scraping surface 73D may be offset from the center axis L of the coating roller 72 as illustrated in FIG. 10 or 11 or may not be offset from the center axis L of the coating roller 72 as illustrated in FIG. 12. For examples in which the scraping surface 73D is offset from the center axis L of the coating roller 72, an imaginary plane extending from the scraping surface 73D does not pass through the center axis L of the coating roller 72. In some examples in which the scraping surface 73D is not offset from the center axis L of the coating roller 72, the imaginary plane extending from the scraping surface 73D passes through the center axis L of the coating roller 72.

When the scraping surface 73D is offset from the center axis L of the coating roller 72, the scraping surface 73D may be offset to the downstream side in the rotational direction of the coating roller 72 with respect to the center axis L of the coating roller 72 as illustrated in FIG. 10, or the scraping surface 73D may be offset to the upstream side in the rotational direction of the coating roller 72 with respect to the center axis L of the coating roller 72 as illustrated in FIG. 11. In the former example, an increase in rotational torque of the coating roller 72 may be prevented. In the latter example, the ability to scrape off the toner from the coating roller 72 may be improved.

Figure 13:
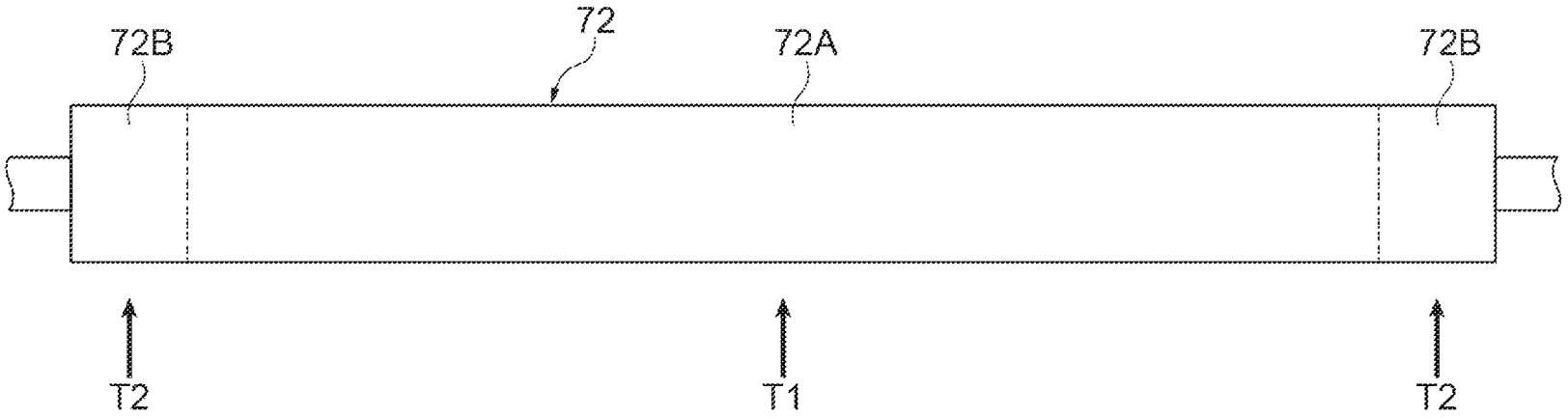
FIG. 13 is a schematic front view illustrating an example operation of a toner supply device.

FIG. 13 is a diagram illustrating another example toner adjustment element. The toner adjustment element illustrated in FIG. 13 adjusts the toner amount of the coating roller 72 in the axial direction of the coating roller 72 by supplying additional toner to the coating roller. The toner adjustment element may supply additional toner to the second portion 72B of the coating roller 72. For example, the toner adjustment element may supply additional toner of a first toner supply amount T1 (a first additional toner supply amount) to the first portion 72A of the coating roller 72 and may supply additional toner of a second toner supply amount T2 (a second additional toner supply amount) which is greater than the first toner supply amount T1 to the second portion 72B of the coating roller 72.

Figure 14:
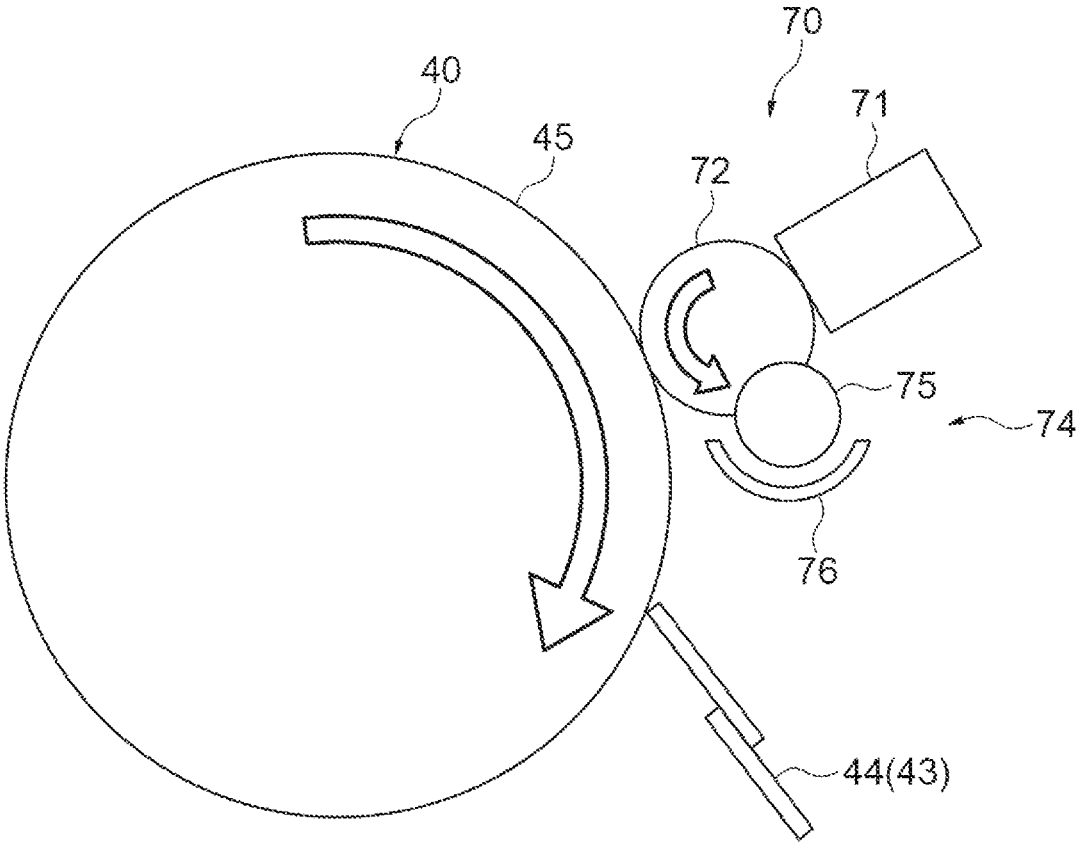
FIG. 14 is a schematic side view illustrating a lubricant application device including an example toner supply device.
Figure 15:
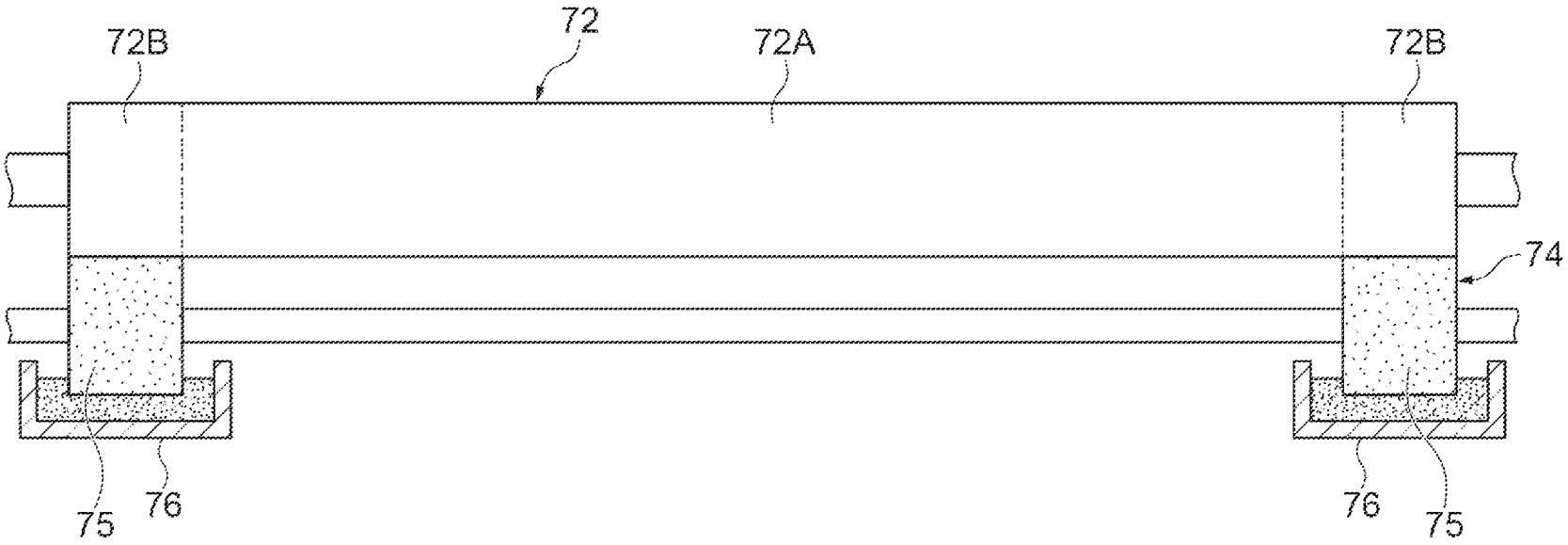
FIG. 15 is a schematic front view illustrating an example positional relationship between the coating roller and the toner supply device illustrated in FIG. 14.

The lubricant application device 70 illustrated in FIGS. 14 and 15 includes a toner supply device 74 which is a toner adjustment element. The toner supply device 74 supplies additional toner to the second portion 72B of the coating roller 72. The toner supply device 74 includes, for example, a toner supply roller 75 and a toner collection mechanism 76.

The toner supply roller 75 supplies additional toner to each second portion 72B of the coating roller 72. The toner supply roller 75 is disposed adjacent to each second portion 72B of the coating roller 72. The toner supply roller 75 is supported to be rotatable about the center axis of the toner supply roller 75 by, for example, a support body directly or indirectly attached to the casing of the imaging apparatus 1. Then, when the toner supply roller 75 rotates, additional toner is supplied to each second portion 72B of the coating roller 72. The toner supply roller 75 may comprise a drive roller or a driven roller. Similarly to the coating roller 72, the toner supply roller 75 may comprise a brush roller (an additional toner supply brush roller) or an elastic roller (an additional toner supply elastic roller).

The toner collection mechanism 76 collects waste toner as additional toner and supplies the collected additional toner to the toner supply roller 75. The toner collection mechanism 76 collects, for example, toner collected from the image carrier 40 by the cleaning device 43 (see FIG. 1) as waste toner. As illustrated in FIG. 14, when the cleaning device 43 includes a cleaning blade 44 which scrapes off a toner from the surface 45 of the image carrier 40, the toner collection mechanism 76 collects the toner (the waste toner) scraped off from the surface 45 of the image carrier 40 by the cleaning blade 44 as additional toner. The toner collection mechanism 76 transports the collected additional toner to the toner supply roller 75 by a toner transportation mechanism such as, for example, an auger.

In some examples, when the toner supply device 74 supplies the additional toner to the second portion 72B of the coating roller 72, a difference between the toner amount of the first portion 72A of the coating roller 72 and the toner amount of the second portion 72B of the coating roller 72 decreases. Accordingly, a substantially uniform lubricant layer may be applied across, for example, the image area 40A and the non-image area 40B of the image carrier 40.

Figure 16:
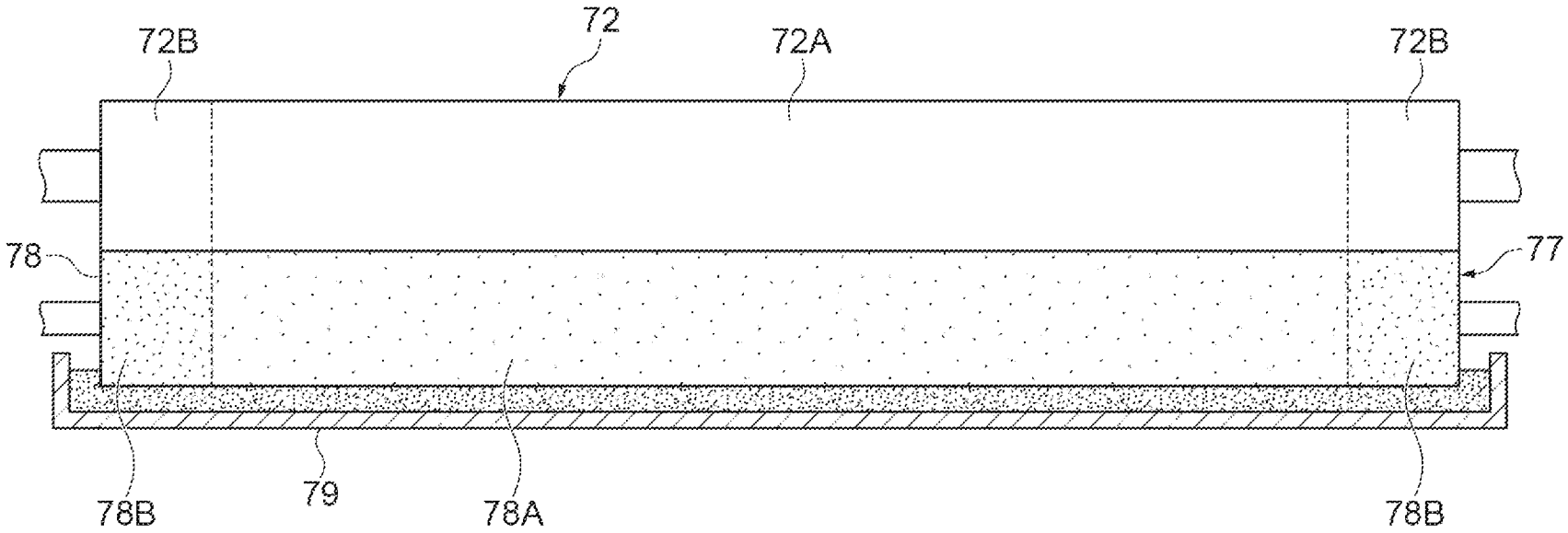
FIG. 16 is a schematic front view illustrating an example positional relationship between the coating roller and another example toner supply device.

The lubricant application device 70 illustrated in FIG. 16 includes a toner supply device 77 or toner adjustment element. The toner supply device 77 supplies additional toner to the first portion 72A and the second portion 72B of the coating roller 72. The toner supply device 77 includes, for example, a toner supply roller 78 and a toner collection mechanism 79.

The toner supply roller 78 includes a first roller portion 78A and a second roller portion 78B. The first roller portion 78A is disposed adjacent to the first portion 72A of the coating roller 72. The second roller portion 78B is disposed adjacent to each second portion 72B of the coating roller 72. The toner supply roller 78 is supported to be rotatable about the center axis of the toner supply roller 78 by, for example, a support body directly or indirectly attached to the casing of the imaging apparatus 1. Then, when the toner supply roller 78 rotates, the additional toner is supplied to the first portion 72A and each second portion 72B of the coating roller 72. The toner supply roller 78 may comprise a drive roller or a driven roller. Similarly to the coating roller 72, the toner supply roller 78 may comprise a brush roller (an additional toner supply brush roller) or an elastic roller (an additional toner supply elastic roller).

The first roller portion 78A supplies the additional toner of the first toner supply amount T1 to the first portion 72A of the coating roller 72. The second roller portion 78B supplies the additional toner of the second toner supply amount T2 to each second portion 72B of the coating roller 72. The second toner supply amount T2 is greater than the first toner supply amount T1.

The first roller portion 78A and the second roller portion 78B may be configured to set the additional toner supply amount according to the propensity or ability for carrying the additional toner. When the first roller portion 78A and the second roller portion 78B are the additional toner supply brush rollers, the ability to carry the additional toner supply amount can be set according to, for example, the total surface area of the bristles, the density of the bristles, the average length of the bristles, the average diameter of the bristles, and the like.

In some examples, when the toner supply device 77 supplies the additional toner to the first portion 72A and each second portion 72B of the coating roller 72, and the toner supply amount for the second portion 72B of the coating roller 72 is set to be greater than the toner supply amount for the first portion 72A of the coating roller 72, a difference between the toner amount of the first portion 72A of the coating roller 72 and the toner amount of the second portion 72B of the coating roller 72 decreases. Accordingly, a substantially uniform lubricant layer may be applied, for example, across the image area 40A and the non-image area 40B of the image carrier 40.

Figure 17:
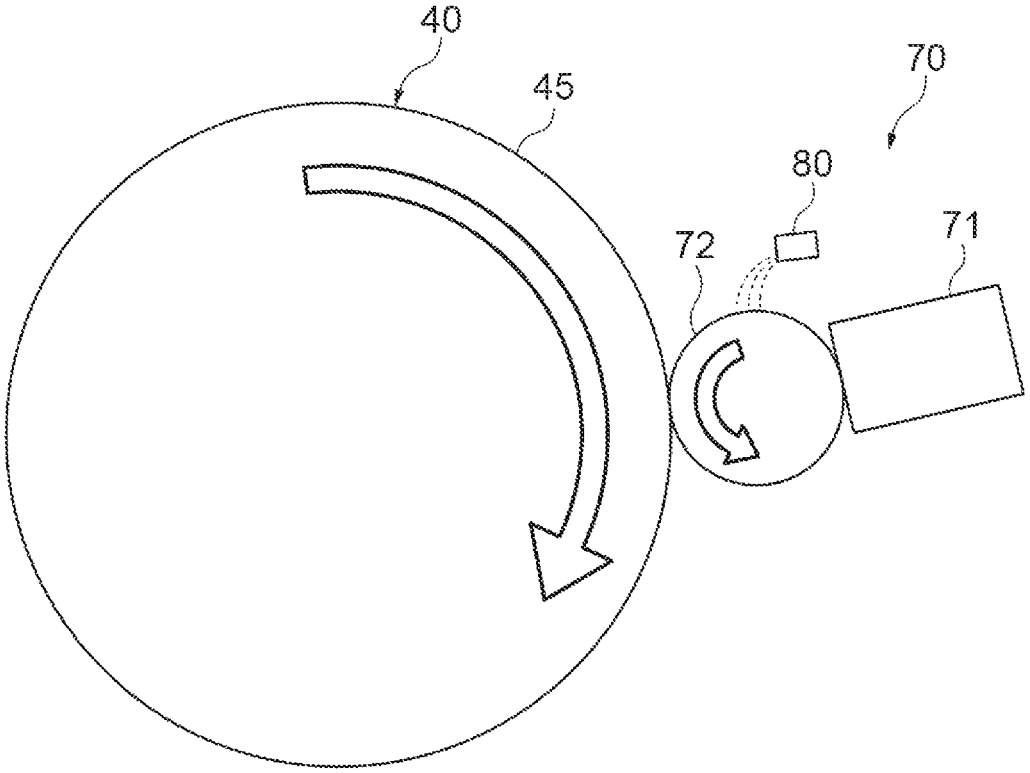
FIG. 17 is a schematic side view illustrating a lubricant application device including another example toner supply device.

Furthermore, the toner supply device 80, or toner adjustment element, may be configured to distribute additional toner to the coating roller 72 as illustrated in FIG. 17. An example method of distributing the additional toner may include dropping, spraying, or otherwise dispensing the toner. The toner supply device 80 may distribute (supply) additional toner to the second portion 72B of the coating roller 72 similarly to the toner supply device 74 illustrated in FIGS. 14 and 15 or may distribute (supply) an additional toner to the first portion 72A and the second portion 72B of the coating roller 72 similarly to the toner supply device 77 illustrated in FIG. 16.

It is to be understood that not all aspects, advantages and features described herein may necessarily be achieved by, or included in, any one particular example. Indeed, having described and illustrated various examples herein, it should be apparent that other examples may be modified in arrangement and detail.

For example, when the coating roller 72 includes a brush roller which extends to cross both the first portion 72A and the second portion 72B of the coating roller 72, the toner adjustment element may be provided by the bristles of the brush roller.

When the toner adjustment element is provided by the bristles of the brush roller which is the coating roller 72, the density of the bristles of the first portion 72A of the brush roller (the coating roller 72) may be different from the density of the bristles of the second portion 72B of the brush roller (the coating roller 72). In some examples, the density of the bristles of the first portion 72A of the coating roller 72 may be greater than the density of the bristles of the second portion 72B of the coating roller 72, in the range in which the additional toner may be carried on the coating roller 72. The range of the density of the bristles for carrying the additional toner on the coating roller 72 may be, for example, between approximately 25,000 lines/square inch and 300,000 lines/square inch.

Further, when the toner adjustment element is provided by the coating roller 72, such as a brush roller, the average length of the bristles of the first portion 72A of the brush roller (the coating roller 72) may be different from the average length of the bristles of the second portion 72B of the brush roller (the coating roller 72). In some examples, the average length of the bristles of the first portion 72A of the coating roller 72 may be greater than the average length of the bristles of the second portion 72B of the coating roller 72, in the range in which the additional toner may be carried on the coating roller 72. The range of the average length of the bristles used for carrying the additional toner on the coating roller 72 may be, for example, between approximately 1 mm and 4 mm.

By way of further example, when the toner adjustment element is provided by the bristles of a brush roller, the average diameter of the bristles of the first portion 72A of the brush roller (the coating roller 72) may be different from the average diameter of the bristles of the second portion 72B of the brush roller (the coating roller 72). In some examples, the average diameter of the bristles of the first portion 72A of the coating roller 72 may be greater than the average diameter of the bristles of the second portion 72B of the coating roller 72, in the range in which the additional toner may be carried on the coating roller 72. The range of the average diameter of the bristles that carry the additional toner on the coating roller 72 may be, for example, between approximately 2 denier and 8 denier.

One or more of the examples described above can be expressed by the clauses provided below.

[Clause 1] An imaging system including:

an image carrier which carries a toner image;

a coating roller which transfers a lubricant from a lubricant source to a surface of the image carrier, the coating roller being disposed adjacent to the image carrier and receiving a toner from the image carrier; and a toner adjustment element which adjusts a toner amount of the coating roller in an axial direction of the coating roller in order to reduce a variation in toner amount of the coating roller in the axial direction of the coating roller.

[Clause 2] The imaging system according to clause 1, wherein the image carrier includes a surface having an image area carrying a toner image and a non-image area located at the outside of the image area, wherein the coating roller includes a first portion which contacts the image area of the image carrier and a second portion which contacts the non-image area of the image carrier, and wherein the toner adjustment element selectively changes a toner amount of at least one of the first portion of the coating roller and the second portion of the coating roller so that a difference between the toner amount of the first portion of the coating roller and the toner amount of the second portion of the coating roller decreases.

[Clause 3] An imaging system including:

an image carrier which includes a surface having an image area carrying a toner image and a non-image area located at the outside of the image area;

a coating roller which transfers a lubricant from a lubricant source to a surface of the image carrier, the coating roller including a first portion which contacts the image area of the image carrier and a second portion which contacts the non-image area of the image carrier, the coating roller receiving the toner from the image carrier and the amount of the lubricant transferred from the lubricant source to the coating roller being changed on the basis of the amount of the toner located on the coating roller when the coating roller contacts the surface of the image carrier; and a toner adjustment element which selectively changes a toner amount of at least one of the first portion of the coating roller and the second portion of the coating roller in order to apply a substantially uniform lubricant layer across the image area and the non-image area of the image carrier.

[Clause 4] The imaging system according to clause 3, wherein the toner adjustment element includes a scraper which is adjacent to the coating roller in order to scrape off the toner from the coating roller, the scraper including a first scraping portion which engages with the first portion of the coating roller, a second scraping portion which engages with the second portion of the coating roller, and an intermediate scraping portion which extends between the first scraping portion and the second scraping portion, wherein a first edge which is an edge on the side of the center axis of the coating roller of the first scraping portion protrudes toward the center axis of the coating roller in relation to a second edge which is an edge on the side of the center axis of the coating roller of the second scraping portion, and wherein an intermediate edge which is an edge on the side of the center axis of the coating roller of the intermediate scraping portion is inclined with respect to the center axis of the coating roller.

[Clause 5] The imaging system according to clause 4, wherein the intermediate edge of the intermediate scraping portion is formed in a curved shape.

[Clause 6] The imaging system according to clause 5, wherein the first edge of the first scraping portion and the intermediate edge of the intermediate scraping portion are connected in a curved shape, and wherein the second edge of the second scraping portion and the intermediate edge of the intermediate scraping portion are connected in a curved shape.

[Clause 7] The imaging system according to any one of clauses 4 to 6, wherein the scraper includes a scraping surface which is offset from the center axis of the coating roller.

[Clause 8] The imaging system according to clause 3, wherein the first portion of the coating roller receives more toner from the image carrier as compared with the second portion of the coating roller, and wherein the toner adjustment element includes a toner supply device which supplies the additional toner to the second portion of the coating roller.

[Clause 9] The imaging system according to clause 8, wherein the toner adjustment element includes a first part which supplies the additional toner of the first toner supply amount to the first portion of the coating roller and a second part which supplies the additional toner of the second toner supply amount to the second portion of the coating roller, and wherein the second toner supply amount is greater than the first toner supply amount.

[Clause 10] The imaging system according to clause 8 or 9, wherein the imaging system includes a toner collection mechanism which collects the toner remaining on the image carrier, and wherein the toner supply device supplies the toner collected by the toner collection mechanism as the additional toner to the coating roller.

[Clause 11] The imaging system according to clause 10, wherein the toner supply device includes a brush roller which is disposed adjacent to the coating roller and supplies the toner collected by the toner collection mechanism as the additional toner to the coating roller.

[Clause 12] The imaging system according to clause 3, wherein the coating roller includes a brush roller which extends across both the first portion and the second portion of the coating roller, and wherein the toner adjustment element is provided by bristles of the brush roller.

[Clause 13] The imaging system according to clause 12, wherein a density of the bristles of the first portion of the brush roller is different from a density of the bristles of the second portion of the brush roller.

[Clause 14] The imaging system according to clause 12 or 13, wherein an average length of the bristles of the first portion of the brush roller is different from an average length of the bristles of the second portion of the brush roller.

[Clause 15] The imaging system according to any one of clauses 12 to 14, wherein an average diameter of the bristles of the first portion of the brush roller is different from an average diameter of the bristles of the second portion of the brush roller.

The invention claimed is:

1. An imaging system comprising:

an image carrier to carry a toner image;

a coating roller to transfer a lubricant from a lubricant source to a surface of the image carrier, the coating roller being disposed adjacent to the image carrier to receive a toner from the image carrier; and a toner adjustment element to adjust a toner amount of the coating roller in an axial direction of the coating roller to reduce a variation in toner amount of the coating roller in the axial direction of the coating roller in order to apply a substantially uniform lubricant layer across an image area and a non-image area of the image carrier.

2. The imaging system according to claim 1, wherein the image carrier includes a surface having the image area to carry a toner image and the non-image area located outside of the image area, wherein the coating roller includes a first portion which contacts the image area of the image carrier and a second portion which contacts the non-image area of the image carrier, and wherein the toner adjustment element is to selectively change a toner amount of at least one of the first portion of the coating roller and the second portion of the coating roller in order to reduce a toner amount differential between the first portion of the coating roller and the second portion of the coating roller.

3. An imaging system comprising:

an image carrier which includes a surface having an image area to carry a toner image and a non-image area located outside of the image area;

a coating roller to transfer a lubricant from a lubricant source to the surface of the image carrier, the coating roller including a first portion which contacts the image area of the image carrier and a second portion which contacts the non-image area of the image carrier, the coating roller to receive toner from the image carrier, and an amount of the lubricant transferred from the lubricant source to the coating roller to change based on an amount of the toner located on the coating roller when the coating roller contacts the surface of the image carrier; and a toner adjustment element to selectively change a toner amount of at least one of the first portion of the coating roller and the second portion of the coating roller in order to apply a substantially uniform lubricant layer across the image area and the non-image area of the image carrier.

4. The imaging system according to claim 3, wherein the toner adjustment element includes a scraper which is located adjacent to the coating roller in order to scrape off the toner from the coating roller, the scraper including a first scraping portion to engage with the first portion of the coating roller, a second scraping portion to engage with the second portion of the coating roller, and an intermediate scraping portion which extends between the first scraping portion and the second scraping portion, wherein a first edge of the intermediate scraping portion is offset from a center axis of the coating roller and protrudes toward the center axis of the coating roller in relation to a second edge of the second scraping portion which is offset from the center axis of the coating roller, and wherein an intermediate edge the intermediate scraping portion is offset from the center axis of the coating roller and is inclined with respect to the center axis of the coating roller.

5. The imaging system according to claim 4, wherein the intermediate edge of the intermediate scraping portion is formed in a curved shape.

6. The imaging system according to claim 5, wherein the first edge of the first scraping portion and the intermediate edge of the intermediate scraping portion are connected in a curved shape, and wherein the second edge of the second scraping portion and the intermediate edge of the intermediate scraping portion are connected in a curved shape.

7. The imaging system according to claim 4, wherein the scraper includes a scraping surface which is offset from the center axis of the coating roller.

8. The imaging system according to claim 3, the first portion of the coating roller to receive more toner from the image carrier as compared with the second portion of the coating roller, and wherein the toner adjustment element includes a toner supply device to supply additional toner to the second portion of the coating roller.

9. The imaging system according to claim 8, wherein the toner adjustment element includes a first part to supply a first additional toner supply amount to the first portion of the coating roller and a second part to supply a second additional toner supply amount to the second portion of the coating roller, and wherein the second additional toner supply amount is greater than the first additional toner supply amount.

10. The imaging system according to claim 8, wherein the imaging system includes a toner collection mechanism to collect the toner remaining on the image carrier, the toner supply device to supply the toner collected by the toner collection mechanism as the additional toner to the coating roller.

11. The imaging system according to claim 10, wherein the toner supply device includes a brush roller which is disposed adjacent to the coating roller to supply the toner collected by the toner collection mechanism as the additional toner to the coating roller.

12. The imaging system according to claim 3, wherein the coating roller includes a brush roller which extends across both the first portion and the second portion of the coating roller, and wherein the toner adjustment element includes bristles of the brush roller.

13. The imaging system according to claim 12, wherein a density of the bristles of the first portion of the brush roller is different from a density of the bristles of the second portion of the brush roller.

14. The imaging system according to claim 12, wherein an average length of the bristles of the first portion of the brush roller is different from an average length of the bristles of the second portion of the brush roller.

15. The imaging system according to claim 12, wherein an average diameter of the bristles of the first portion of the brush roller is different from an average diameter of the bristles of the second portion of the brush roller.

* * * * *